US008408983B2

(12) United States Patent
Dunaevsky et al.

(10) Patent No.: US 8,408,983 B2
(45) **Date of Patent: *Apr. 2, 2013**

(54) MULTI-HAND ELECTRONIC BLACKJACK GAME

(75) Inventors: Vladimir Dunaevsky, Toronto (CA); Justin L. Thouin, Toronto (CA); Serge Bourenkov, Toronto (CA)

(73) Assignee: Cryptologic Inc., Toronto (CA)

( * ) Notice: Subject to any disclaimer, the term of this patent is extended or adjusted under 35 U.S.C. 154(b) by 158 days.

This patent is subject to a terminal disclaimer.

(21) Appl. No.: 12/852,809

(22) Filed: Aug. 9, 2010

(65) Prior Publication Data

US 2010/0298039 A1 Nov. 25, 2010

Related U.S. Application Data

(63) Continuation of application No. 11/712,509, filed on Mar. 1, 2007, now Pat. No. 7,824,254.

(60) Provisional application No. 60/780,282, filed on Mar. 9, 2006.

(51) Int. Cl.
*A63F 9/24* (2006.01)

(52) U.S. Cl. ..... 463/12; 463/10; 463/13; 463/20

(58) Field of Classification Search ..... 463/10, 463/12, 13, 20
See application file for complete search history.

(56) References Cited

U.S. PATENT DOCUMENTS

| | | | | |
|---|---|---|---|---|
| 5,154,429 | A * | 10/1992 | LeVasseur | 273/292 |
| 5,257,789 | A | 11/1993 | LeVasseur | |
| 5,280,915 | A | 1/1994 | Groussman | |
| 5,356,140 | A | 10/1994 | Dabrowski | |
| 5,377,993 | A | 1/1995 | Josephs | |
| 5,411,268 | A | 5/1995 | Nelson | |
| 5,732,950 | A | 3/1998 | Moody | |
| 5,800,268 | A | 9/1998 | Molnick | |
| 5,810,360 | A | 9/1998 | Srichayaporn | |
| 5,823,873 | A | 10/1998 | Moody | |
| 5,839,731 | A | 11/1998 | Feola | |
| 5,873,571 | A | 2/1999 | Vaisman | |
| 5,954,335 | A | 9/1999 | Moody | |
| 6,007,066 | A | 12/1999 | Moody | |
| 6,311,978 | B1 | 11/2001 | Moody | |
| 6,322,075 | B1 | 11/2001 | DeFranco | |
| 6,540,228 | B2 | 4/2003 | Delello | |
| 6,726,427 | B2 * | 4/2004 | Jarvis et al. | 273/292 |
| 6,959,927 | B1 | 11/2005 | Jacobs et al. | |
| 6,969,316 | B2 | 11/2005 | Jarvis | |
| 2001/0019193 | A1 | 9/2001 | Gumina | |
| 2001/0035604 | A1 | 11/2001 | Jones | |
| 2003/0090063 | A1 | 5/2003 | Jarvis | |
| 2003/0162594 | A1 | 8/2003 | Rowe | |
| 2004/0192425 | A1 | 9/2004 | Jarvis | |
| 2005/0040599 | A1 | 2/2005 | Snow | |
| 2005/0143157 | A1 | 6/2005 | Stelzer et al. | |
| 2006/0281537 | A1 | 12/2006 | Abbott et al. | |

* cited by examiner

*Primary Examiner* — Paul A. D'Agostino
*Assistant Examiner* — Brandon Gray
(74) *Attorney, Agent, or Firm* — Bereskin & Parr LLP/S.E.N.C.R.L., s.r.l.

(57) ABSTRACT

A method and gaming device for playing an electronic multi-hand blackjack game is disclosed. The game includes:

a) dealing a player hand of two face-up cards;

b) dealing two or more dealer hands such that each dealer hand is dealt from a corresponding shoe made up on at least one deck of cards, where each dealer hand includes one identical face-up card and one face-down card;

c) completing the player hand according to input received from the player;

d) completing each of the dealer hands according to conventional rules of blackjack, such that the cards in each dealer hand are drawn from the corresponding shoe and no two dealer hands are drawn from the same shoe; and e) determining a number of game results by comparing the player hand against each of the dealer hands using conventional rules of blackjack.

40 Claims, 8 Drawing Sheets

Atlantic City Blackjack

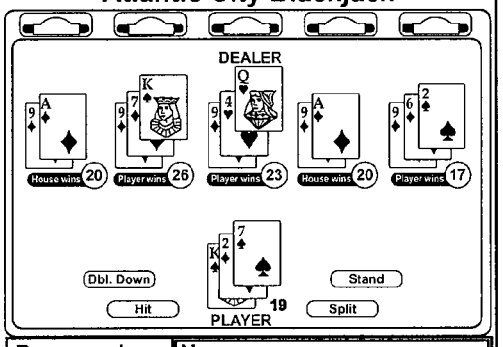

| | |
|---|---|
| Progressive | No |
| Decks/shoe | 8 x 52 |
| Multi-Hand | No |
| Dealer Hits | Stands on all 17's |
| Bonus Bet | No |
| Insurance | Yes |
| Surrender | No surrender |
| Double Down | Yes |
| Split | No re-splitting allowed |
| Split Aces | Yes |
| Re-Split Aces | No |

Single Deck Blackjack

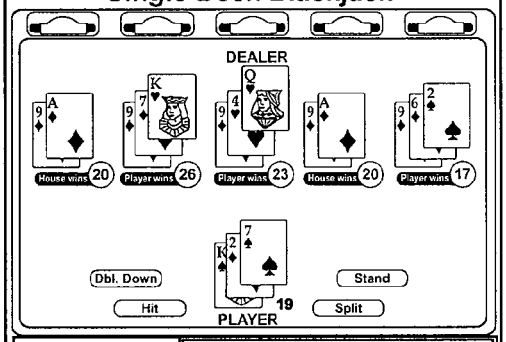

| | |
|---|---|
| Progressive | No |
| Decks/shoe | 1 x 52 |
| Multi-Hand | No |
| Dealer Hits | Draw soft 17, stand hard 17 |
| Bonus Bet | No |
| Insurance | Yes |
| Surrender | No surrender |
| Double Down | Yes |
| Split | No re-splitting allowed |
| Split Aces | Yes |
| Re-Split Aces | No |

Super Fun 21

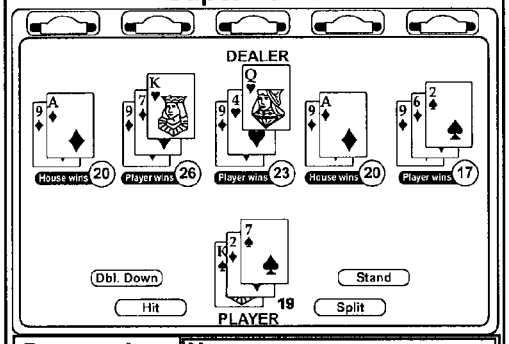

| | |
|---|---|
| Progressive | No |
| Decks/shoe | 1 x 52 |
| Multi-Hand | No |
| Dealer Hits | Hits a soft 17 |
| Bonus Bet | Yes |
| Insurance | Yes |
| Surrender | Dealer can't have Blackjack |
| Double Down | Yes, at any time |
| Split | Split pairs up to 3 hands |
| Split Aces | Yes |
| Re-Split Aces | Yes |

Progressive Blackjack

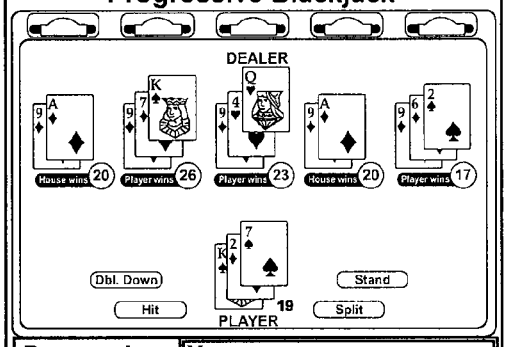

| | |
|---|---|
| Progressive | Yes |
| Decks/shoe | 8 x 52 |
| Multi-Hand | No |
| Dealer Hits | Stands on all 17's |
| Bonus Bet | Yes |
| Insurance | Yes |
| Surrender | No surrender |
| Double Down | Yes |
| Split | No re-splitting allowed |
| Split Aces | Yes |
| Re-Split Aces | No |

FIG. 8

MULTI-HAND ELECTRONIC BLACKJACK GAME

CROSS-REFERENCE TO RELATED APPLICATIONS

This application is a continuation of U.S. patent application Ser. No. 11/712,509, filed Mar. 1, 2007, which claims the benefit of U.S. Provisional Application No. 60/780,282, filed on Mar. 9, 2006. These applications are incorporated herein by reference in their entirety.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the file or records of the patent office of any jurisdiction, but otherwise reserves all copyright rights whatsoever.

FIELD OF THE INVENTION

The present invention relates generally to an electronic blackjack card game. More particularly, the present invention relates to an electronic blackjack card game where a player plays one or more player hands against multiple dealer hands.

BACKGROUND OF THE INVENTION

Blackjack, also known as Twenty-One, is a card game that has been played for many decades by recreational players and gamblers. Blackjack is a mainstay at casinos all over the United States and the world.

Generally, at casinos, blackjack is played according to a set of standardized rules. These standardized rules include rules regarding the play of the cards and rules regarding how the players may place wagers.

In recent years, video blackjack has become popular. Video blackjack (also referred to as electronic blackjack) is played on stand-alone gaming devices or on client devices, such as computers or the like, which communicate with servers over a network, such as the Internet.

Typically, video blackjack is played by individuals against the house (also referred to as the "dealer). The dealing of the cards from virtual decks and shoes is controlled by one or more computers. Certain known video blackjack games permit a player to play several hands simultaneously against a dealer hand. Such games permit the player to obtain a greater number of game outcomes per duration of time played, and at the same time, typically enables the video blackjack provider to increase profits due to the increased number of outcomes.

However, these prior art games do not take full advantage of the increased game speed and number of outcomes possible using electronic means, such as the Internet or gaming machines.

Accordingly, there is a need for systems and methods for playing an improved electronic multi-hand blackjack game.

SUMMARY OF THE INVENTION

According to a first aspect of the invention, a method for playing an electronic multi-hand blackjack game by a player is provided. The method comprises:

a) dealing a player hand, the player hand comprising two cards dealt face-up;

b) dealing a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes comprises at least one deck of cards;

c) completing the player hand according to input received from the player;

d) completing each of the plurality of dealer hands according to the conventional rules of blackjack, wherein the cards comprising each dealer hand are drawn from the corresponding shoe and no two dealer hands are drawn from the same shoe; and e) determining a plurality of game results, wherein the plurality of game results are determined by comparing the player hand against each of the plurality of dealer hands using the conventional rules of blackjack.

Preferably, the cards dealt to the player in steps (a) and (c) above are removed from each of the plurality of shoes.

According to a second aspect of the invention, a method for playing an electronic multi-hand blackjack game over a computer network is provided. The method utilizes a client device adapted for communication with a server via the computer network. The method comprises:

a) dealing a player hand, the player hand comprising two cards dealt face-up;

b) dealing a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes comprises at least one deck of cards;

c) completing the player hand according to instructions received from the client device;

d) completing each of the plurality of dealer hands according to the conventional rules of blackjack, wherein the cards comprising each dealer hand are drawn from the corresponding shoe and no two dealer hands are drawn from the same shoe; and e) determining a plurality of game results, wherein the plurality of game results are determined by comparing the player hand against each of the plurality of dealer hands using the conventional rules of blackjack.

Preferably, the cards dealt to the player in steps (a) and (c) above are removed from each of the plurality of shoes.

According to a third aspect of the invention, a method for playing an electronic multi-hand blackjack game over a computer network is provided. The method utilizes a client device adapted for communication with a server via the computer network. The method comprises:

a) displaying a player hand, the player hand comprising two cards dealt face-up;

b) displaying a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes comprises at least one deck of cards;

c) displaying a completed player hand according to input received from the player;

d) displaying a plurality of completed dealer hands, wherein the plurality of completed dealer hands are completed according to the conventional rules of blackjack, wherein the cards comprising each dealer hand are drawn from the corresponding shoe and no two dealer hands are drawn from the same shoe; and e) displaying a plurality of game results, wherein the plurality of game results are determined by comparing the completed player hand against each of the plurality of completed dealer hands using the conventional rules of blackjack.

Preferably, the cards in the completed player hand are removed from each of the plurality of shoes.

According to a fourth aspect of the present invention, a gaming device for enabling a player to play an electronic multi-hand blackjack game is provided. The gaming device comprises:

a) an input device;

b) a display; and c) a microprocessor operable with the input device and the display to:

i) deal a player hand, the player hand comprising two cards dealt face-up;

ii) deal a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes comprises at least one deck of cards;

iii) complete the player hand according to input received from the input device;

iv) complete each of the plurality of dealer hands according to the conventional rules of blackjack, wherein the cards comprising each dealer hand are drawn from the corresponding shoe and no two dealer hands are drawn from the same shoe; and v) determine a plurality of game results, wherein the plurality of game results are determined by comparing the player hand against each of the plurality of dealer hands using the conventional rules of blackjack.

Preferably, the cards dealt to the player hand are removed from each of the plurality of shoes.

According to a fifth aspect of the present invention, a system for enabling a player to play an electronic multi-hand blackjack game is provided. The system comprises:

a) a server;

b) a client device adapted for communication with the server via a network; and c) the server operable with the client device to:

i) deal a player hand, the player hand comprising two cards dealt face-up;

ii) deal a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes comprises at least one deck of cards;

iii) complete the player hand according to input received from the input device;

iv) complete each of the plurality of dealer hands according to the conventional rules of blackjack, wherein the cards comprising each dealer hand are drawn from the corresponding shoe and no two dealer hands are drawn from the same shoe; and v) determine a plurality of game results, wherein the plurality of game results are determined by comparing the player hand against each of the plurality of dealer hands using the conventional rules of blackjack.

BRIEF DESCRIPTION OF THE DRAWINGS

FIG. 8 is an exemplary screen shot that illustrates various sets of rules for blackjack.

DETAILED DESCRIPTION OF THE INVENTION

Figure 1:
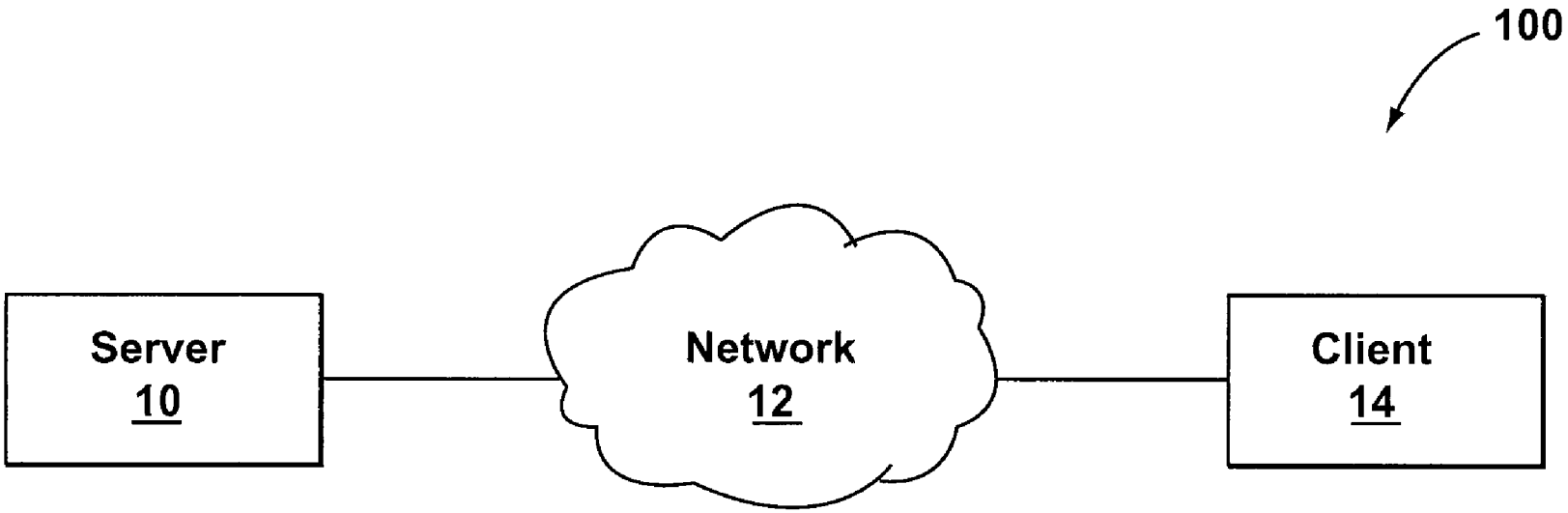
FIG. 1 is a block diagram of a system for playing an electronic multi-hand blackjack game according to an exemplary embodiment of the present invention.

It will be appreciated that for simplicity and clarity of illustration, where considered appropriate, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

The embodiments of the systems, devices and methods described herein may be implemented in hardware or software, or a combination of both. However, preferably, these embodiments are implemented in computer programs executing on programmable computers each comprising at least one processor, a data storage system (including volatile and non-volatile memory and/or storage elements), at least one input device, and at least one output device. For example and without limitation, the programmable computers may be a personal computer, laptop, personal data assistant, and cellular telephone. Program code is applied to input data to perform the functions described herein and generate output information. The output information is applied to one or more output devices, in known fashion.

Each program is preferably implemented in a high level procedural or object oriented programming and/or scripting language to communicate with a computer system. However, the programs can be implemented in assembly or machine language, if desired. In any case, the language may be a compiled or interpreted language. Each such computer program is preferably stored on a storage media or a device (e.g. ROM or magnetic diskette) readable by a general or special purpose programmable computer, for configuring and operating the computer when the storage media or device is read by the computer to perform the procedures described herein. The inventive methods may also be considered to be implemented as a computer-readable storage medium, configured with a computer program, where the storage medium so configured causes a computer to operate in a specific and predefined manner to perform the functions described herein.

Furthermore, the system, processes and methods of the described embodiments are capable of being distributed in a computer program product comprising a computer readable medium that bears computer usable instructions for one or more processors. The medium may be provided in various forms, including one or more diskettes, compact disks, tapes, chips, wireline transmissions, satellite transmissions, internet transmission or downloadings, magnetic and electronic storage media, digital and analog signals, and the like. The computer useable instructions may also be in various forms, including compiled and non-compiled code.

Described herein are various embodiments of a gaming device and method for playing an electronic multi-hand blackjack game (sometimes referred to herein as "the game" for conciseness).

FIG. 1 shows one embodiment of a system 100 for implementing the method according to a preferred embodiment of the present invention. The system 100 includes a client device 14 that is connected to a server 10 via a network 12. A player may use the client device 14 to access the game functionality, which is hosted on the server 10. Preferably, the game functionality is implemented electronically by software that runs on the server 10.

The server 10 is preferably implemented by the use of one or more general purpose computers, such as, for example, a Sun Microsystems F15k. The client device 14 is any suitable computing device, such as a personal computer, wireless phone, personal digital assistant (PDA), set-top box, gaming device, or any other wired or wireless networked computing device. Preferably, an Internet browser program is running on the client device 14. Each of the server 10 and the client device 14 may include a microprocessor. The microprocessor can be any type of processor, such as, for example, any type of general purpose, microprocessor or microcontroller, a digital signal processing (DSP) processor, an application-specific integrated circuit (ASIC), a programmable read-only memory (PROM), or any combination thereof. The server 10 may use its microprocessor to read a computer readable medium containing software that includes instructions for carrying out one or more of the functions of the server 10, as further described below.

Each of the server 10 and the client device 14 may also include computer memory, such as, for example, random-access memory (RAM). However, the computer memory of each of the server 10 and the client device 14 can be any type of computer memory or any other type of electronic storage medium that is located either internally or externally to the server 10 or the client device 14, such as, for example, read-only memory (ROM), compact disc read-only memory (CDROM), electro-optical memory, magneto-optical memory, an erasable programmable read-only memory (EPROM), and electrically-erasable programmable read-only memory (EEPROM) or the like. According to the exemplary embodiments, the respective RAM can contain, for example, the operating program for either the host server 10 or the client device 14. As will be appreciated based on the following description, the RAM can, for example, be programmed using conventional techniques known to those having ordinary skill in the art of computer programming. The actual source code or object code for carrying out the steps of, for example, a computer program can be stored in the RAM. Each of the host server 10 and the client device 14 can also include a database. The database can be any type of computer database for storing, maintaining, and allowing access to electronic information stored therein. The server 10 preferably resides on a network 12, such as a local area network (LAN), a wide area network (WAN), or the Internet. The client device 14 preferably is connected to the network 12 on which the server 10 resides, thus enabling electronic communications between the server 10 and the client device 14 over a communications connection, whether locally or remotely, such as, for example an Ethernet connection, as RS-232 connection, or the like.

The client device 14 may include a monitor for displaying the actions and status of the game. The client device 14 may be configured to accept user inputs provided via any suitable input device, such as a keyboard, a mouse, a touch screen, or a joystick.

Figure 2:
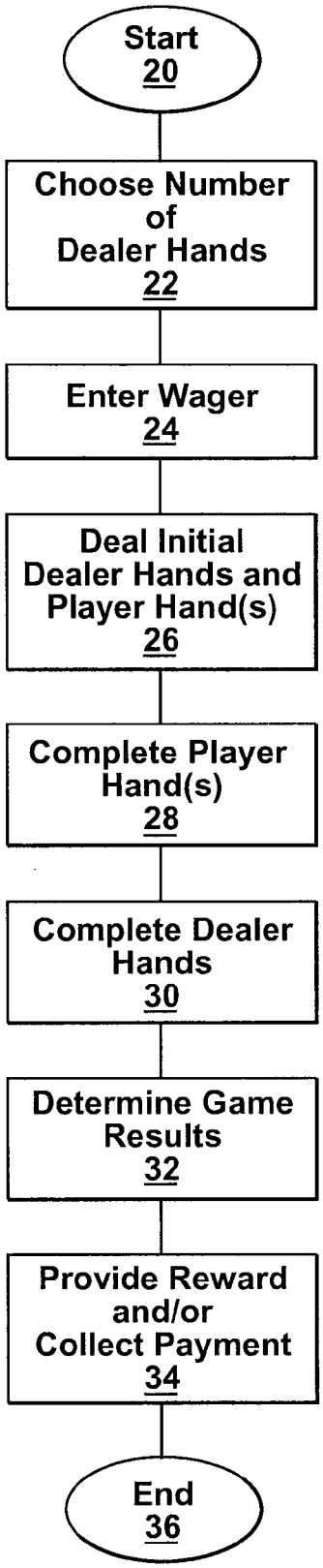
FIG. 2 is a flowchart showing the method of playing an electronic multi-hand blackjack game according to an exemplary embodiment of the present invention.

Referring to FIG. 2, the method of playing the game according to an exemplary embodiment of the present invention will now be described.

The method begins at step 20. At step 22, the player is prompted to enter the number of dealer hands against which the player would like to play. The player enters this information into the client device 14 which communicates it to the server 10 over the network 12. The game may provide the player with the option to play multiple player hands as well as multiple dealer hands. In this case, the player is also prompted to enter the number of player hands to play. It will be understood by those skilled in the art that this step is not essential. In particular, the number of dealer hands and the number of player hands may be fixed, which would obviate the need for this step.

At step 24, the player may be prompted by the client device 14 to enter a wager for each game result. The player inputs the wager into the client device 14. The wager is then communicated to the server 10 by client device 14. The wager may be a monetary amount or any other suitable wager.

At step 26, the initial cards for the dealer hands and the player hand or hands (depending on the number of player hands selected) are dealt. As used herein, "deal" or "deal" means the card is randomly generated by the server 10 and communicated to the client device 14, which displays or otherwise identifies the card to the player. Each initial dealer hand is dealt two cards. One of the cards is dealt face-up and the other is dealt face down. The face-up card of each dealer hand is identical. Each initial player hand is also dealt two cards. Preferably, all of the cards in each player hand are dealt face up.

Preferably, all of the cards for each dealer hand are dealt from a corresponding shoe, such that no two dealer hands are dealt from the same shoe. Preferably, the number of shoes is equal to the number of dealer hands. As used herein, the term "shoe" means a virtual shoe, implemented in software and/or hardware using any suitable data structure. Each shoe may contain one or more decks of cards. Preferably, standard 52 card decks of playing cards are used. The number of decks of cards in a shoe may be fixed, for example at eight decks per shoe, or may be selected by the player, for example, in step 22.

Preferably, the initial cards of each player hand are removed from each card shoe corresponding to each dealer hand.

At step 28, the player's hand is completed in accordance with input from the player based on the rules of conventional blackjack. The player may decide whether to draw one or more additional cards. This strategy is referred to as "hitting". When the player is satisfied with his hand, he may decide not to draw any more cards. This strategy is commonly referred to as "standing". If by hitting, the numerical value of the player hand exceeds twenty one, the player cannot hit any more and, preferably, the player automatically loses to all of the dealer hands. This is referred to as "busting".

The player inputs his/her decision to hit or stand into the client device 14 which communicates the information to the server 10. If the player has decided to hit, the server 10 generates the additional card and communicates the card to the client device 14. The client device 14 displays the card to the player. Preferably, the server 10 also removes each additional card in the player hand from each of the card shoes.

If the player is playing more than one player hands, each subsequent player hand is completed in the manner discussed above.

At step 30, the server 10 completes each of the dealer hands in accordance with conventional rules of blackjack. One example of such rules are commonly referred to as Atlantic City Blackjack rules. According to these rules, the dealer hand must hit if its numerical value is sixteen or less, and the dealer hand must stand if its numerical value is seventeen or more. As discussed in more detail below with reference to FIG. 8, any other suitable alternative blackjack rules may be used. As discussed above, any additional cards drawn for a dealer hand are drawn from the corresponding shoe. The server 10 determines if, according to the above rules, an additional card should be drawn for a particular dealer hand. If so, the server 10 generates the card and communicates the information to the client device 14, which displays the card to the player.

At step 32, the game results are determined by the server 10. Specifically, the server 10 determines the numerical value of the player hand and dealer hands and compares the numerical value of each dealer hand against the value of the player hand. If the player plays one player hand, then the number of game results is equal to the number of dealer hands. If the player plays multiple player hands against multiple dealer hands, then the number of game results may be expressed using the following formula:

$$GR=D\times P$$

where GR is the number of game results, D is the number of dealer hands, and P is the number of player hands.

A game result may be one of three outcomes as follows: a player win, a player loss, and a tie. A player win occurs when the numerical value of the player hand (which has not busted) exceeds the numerical value of one of the dealer hands. A tie occurs when the numerical values of a player hand (which has not busted) and a dealer hand are equal. A player loss occurs when: (i) the numerical value of the player hand is less than the numerical value of one of the dealer hands; or (ii) the player hand has busted. In the case of a busted player hand, such player hand loses against all dealer hands regardless of whether any dealer hand also busts.

At step 34, the server 10 determines the reward and/or collects payment for each game result determined at step 32. For each player loss, the player preferably forfeits his wager. For each tie, the player's wager is preferably returned to the player. For each player win, an amount double the player's wager is preferably returned. A reward may be provided on an individual game result basis. Alternatively, the server 10 may aggregate all game results to determine whether there was a net loss or gain by the player and either debit or credit the player's account by the net loss or net gain, respectively.

Figure 3:
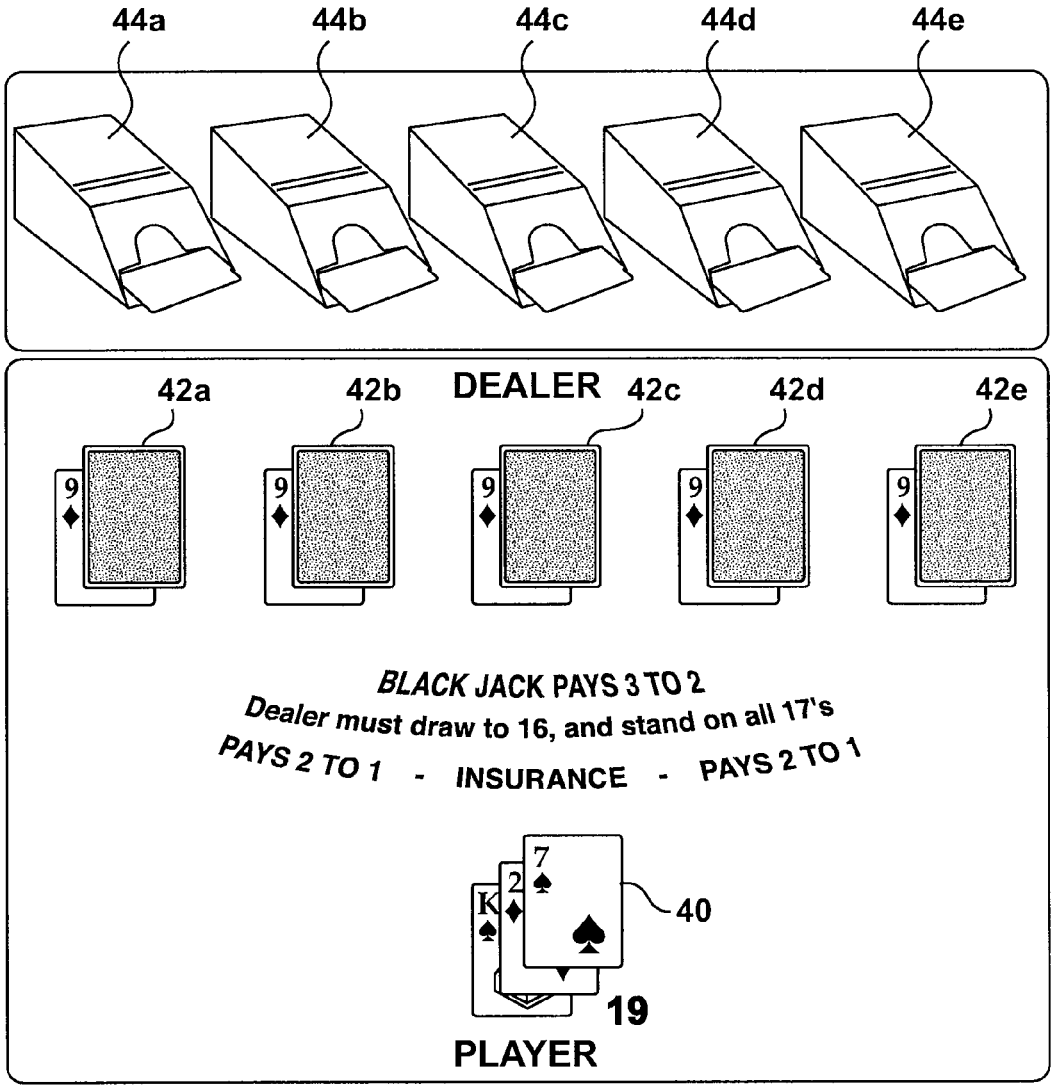
FIG. 3 is an exemplary screen shot that illustrates a completed single player hand and five initial dealer hands according to one embodiment of the present invention.

FIG. 3 shows a screen shot of the game according to one exemplary embodiment. In this screen shot, a completed player hand 40 and five initial dealer hands 42*a-e* are illustrated. The completed player hand 40 (consisting of a King of Spades, a Two of Diamonds, and a Seven of Spades) has a numerical value of nineteen. Each initial dealer hand 42*a-e* preferably consists of a pair of cards, one of which is dealt face-up. The face-up card for each dealer hand is identical—the Nine of Diamonds. Card shoes 44*a-e* corresponding to each initial dealer hand 42*a-e*, respectively, are also illustrated. In this example, the Nine of Diamonds and preferably all of the cards in the player hand 40 (i.e. the King of Spades, a Two of Diamonds, and a Seven of Spades) are all removed from each card shoe 44*a-e*.

Figure 4:
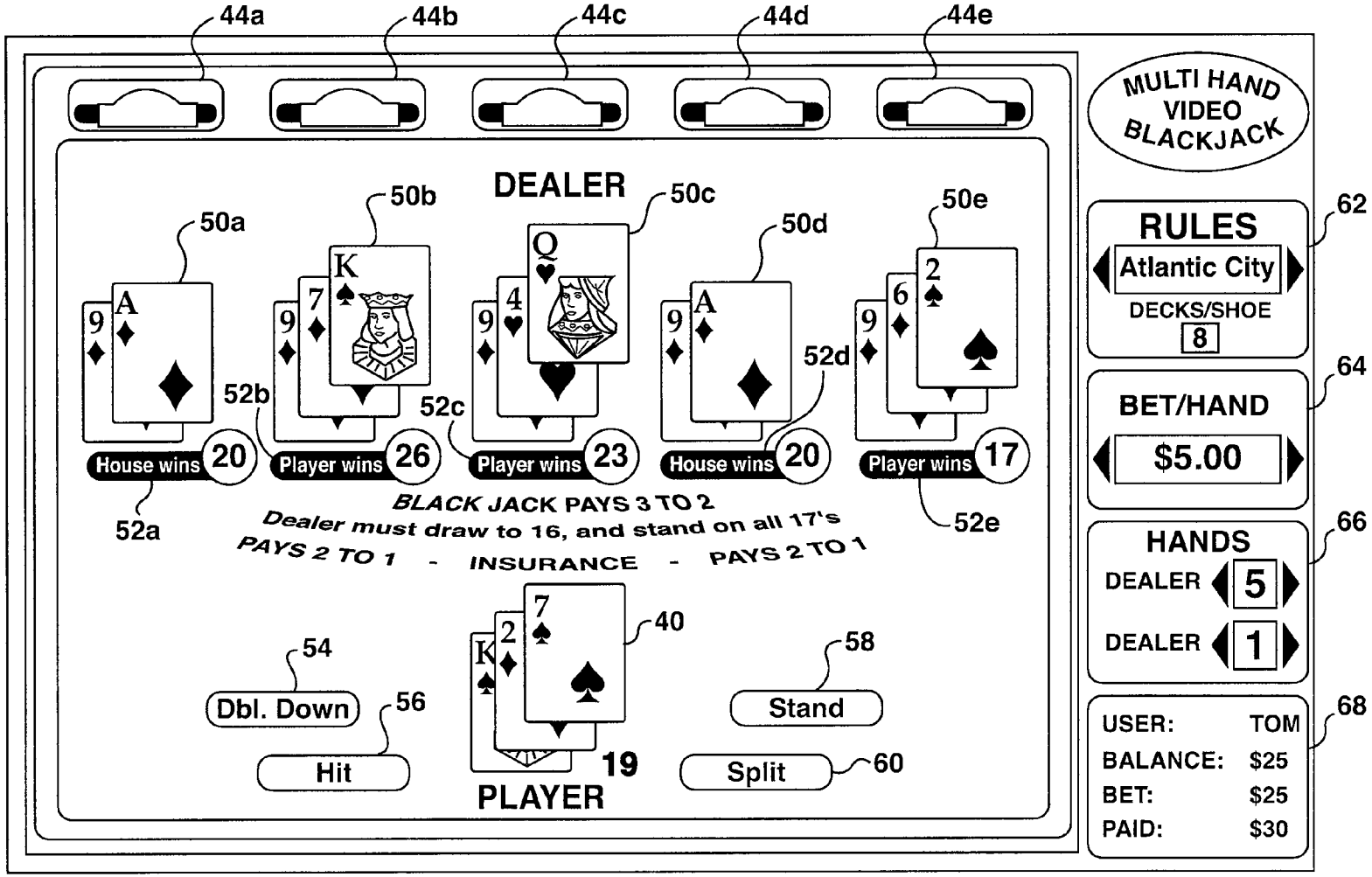
FIG. 4 is an exemplary screen shot that illustrates a completed single player hand and five completed dealer hands, together with an indication of whether the player or the dealer has won each hand, according to one embodiment of the invention.

FIG. 4 shows a screen shot of the game following the completion of the dealer hands and calculation of game results. In particular, FIG. 4 shows the completed player hand 40 and the completed dealer hands 50*a-e*. The completed dealer hands were completed in accordance with the Atlantic City Blackjack rules described above. The additional cards required to complete each dealer hand 50*a-e* are drawn from the corresponding shoe 44*a-e*. In other words, the Ace of Diamonds in completed dealer hand 50*a* a was drawn from shoe 44*a*. The Seven of Diamonds and King of Spades in completed dealer hand 50*b* were drawn from shoe 44*b*, and so on.

The numerical value of each completed dealer hand 50*a-e* and the game result against the player hand 40 (which has a numerical value of nineteen) is shown at panel 52*a-e*. In this example, the player hand 40 loses against dealer hands 50*a* and 50*d* and wins against dealer hands 50*b*, 50*c*, and 50*e*.

Continuing to refer to FIG. 4, "Dbl. Down" 54, "Hit" 56, "Stand" 58, and "Split" 60 command buttons are provided. The functionality of the "Hit" and "Stand" buttons have been described above.

The "Dbl. Down" button 54 has the effect of doubling the amount of the player's wager against each dealer hand, and also requires that the player take exactly one hit and then stand.

The player may be given the option to use the "Split" button 60 when a player is dealt two cards that have the same face value, such as two Sixes or two Aces. If the player clicks the "Split" button 60, two cards in the initial player hands are split into two separate hands, each of which has one of the two cards originally dealt to the player. The player then has the option to complete each of the two hands as discussed above.

Continuing to refer to FIG. 4, a game selection panel 62 may be provided. The game selection panel displays the rules governing the game as well as the number of decks per shoe. In this example, eight decks per shoe is used.

A bet selection panel 64 displays the wager per game. In this example, a wager of $5 per game is shown. A hand selection panel 66 shows the number of dealer hands (five in this example) and the number of player hands (one in this example) being played. Using the formula described above, the number of game results (GR) is equal to 5.

A user information panel 68 provides identifying information such as the player's names and financial information relating to betting and the balance in the player's account.

Figure 5:
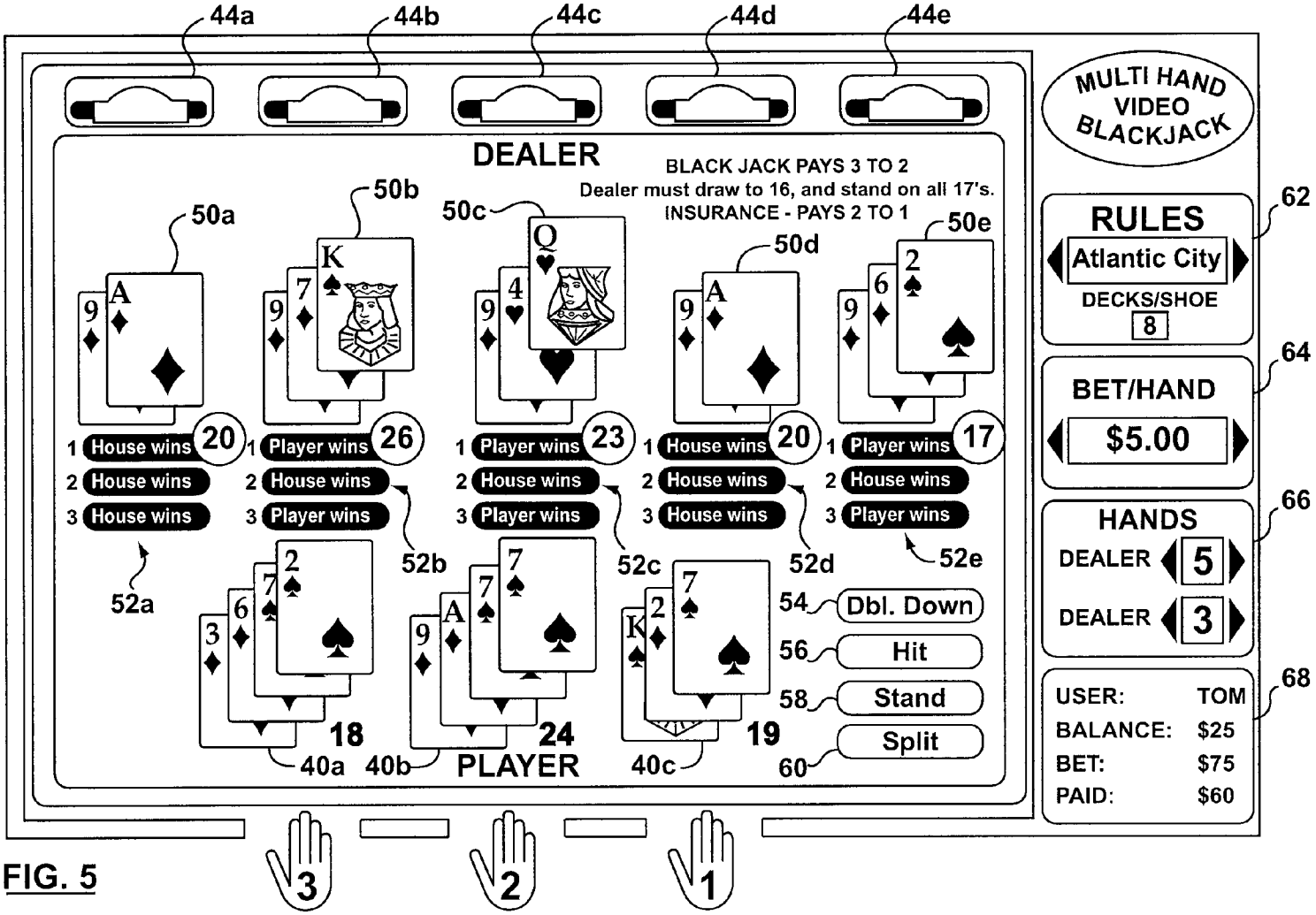
FIG. 5 is an exemplary screen shot that illustrates three completed player hands and five completed dealer hands, according to one embodiment of the invention.

FIG. 5 shows a screen shot of an exemplary embodiment of the game where the player plays three player hands against five dealer hands. Accordingly, the number of game results (GR) is calculated as follows:

$$GR=5\times 3=15$$

The panels 52*a-e* describe the outcome of each of the three player hands 40*a-c* against the particular dealer hand. As can be seen in this example, the player lost nine game results and won in six game results, resulting in a net loss of $15 by the player.

In this example, all of the cards from each player hand 40*a-c* are preferably removed from each card shoe 44*a-e*.

Like parts in FIG. 5 have been assigned like reference numbers and will not be further described.

In an alternative embodiment of the invention, each player hand 40*a-c* may be controlled by a different player. The game results are determined in the same fashion as described above.

Each player's account may be debited or credited in accordance with the game results of such player's hand against each of the dealer hands 50*a-e*.

Figure 6:
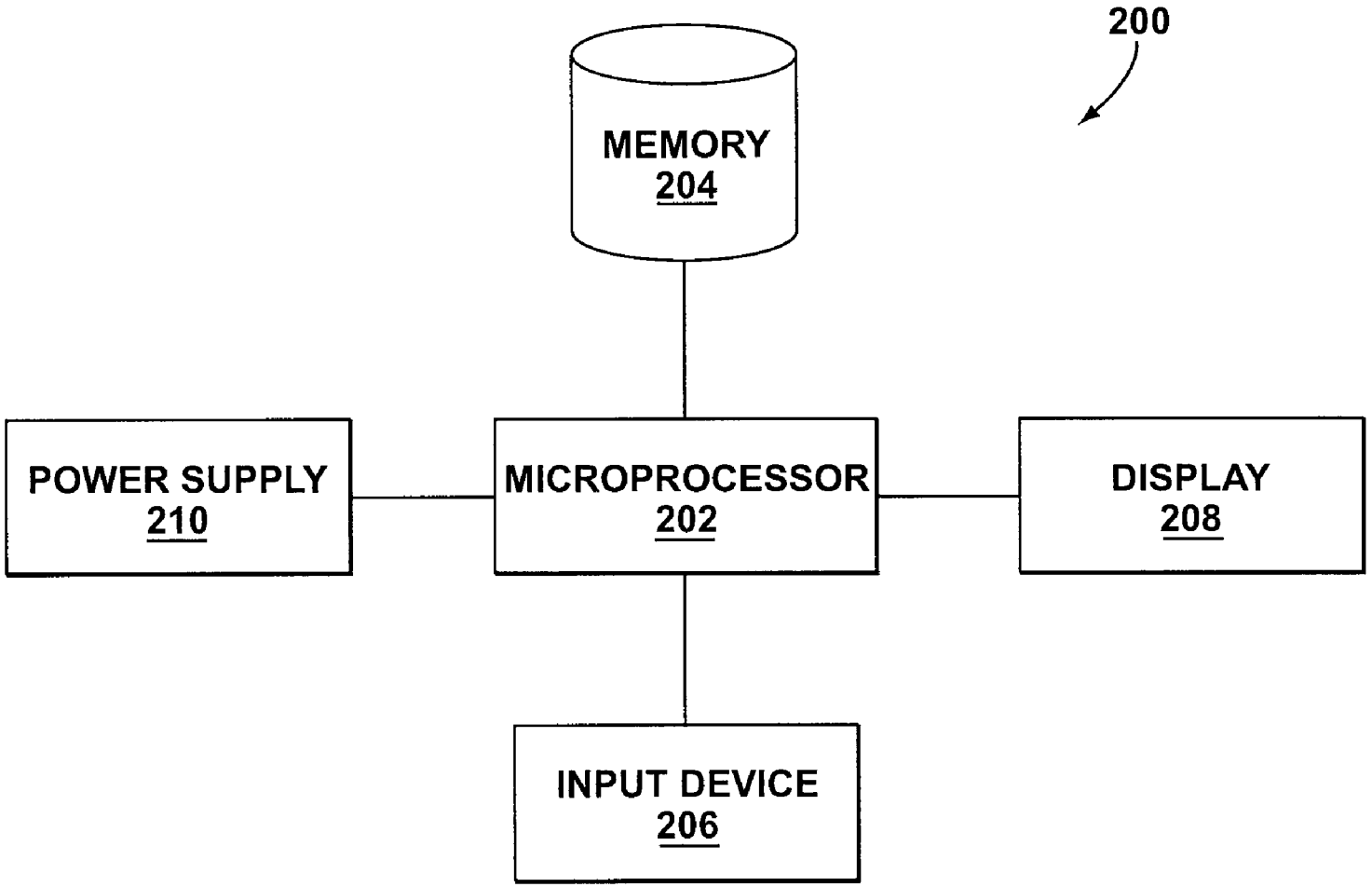
FIG. 6 is a block diagram of a gaming device according to an alternative embodiment of the present invention.

Referring now to FIG. 6, in an alternative embodiment of the present invention, the game may be implemented on a gaming device 200. The gaming device may have components such as a microprocessor 202, a memory 204, input device 206 (such as a keypad, touch screen, or the like), a display screen 208, and a power supply 210.

Figure 7:
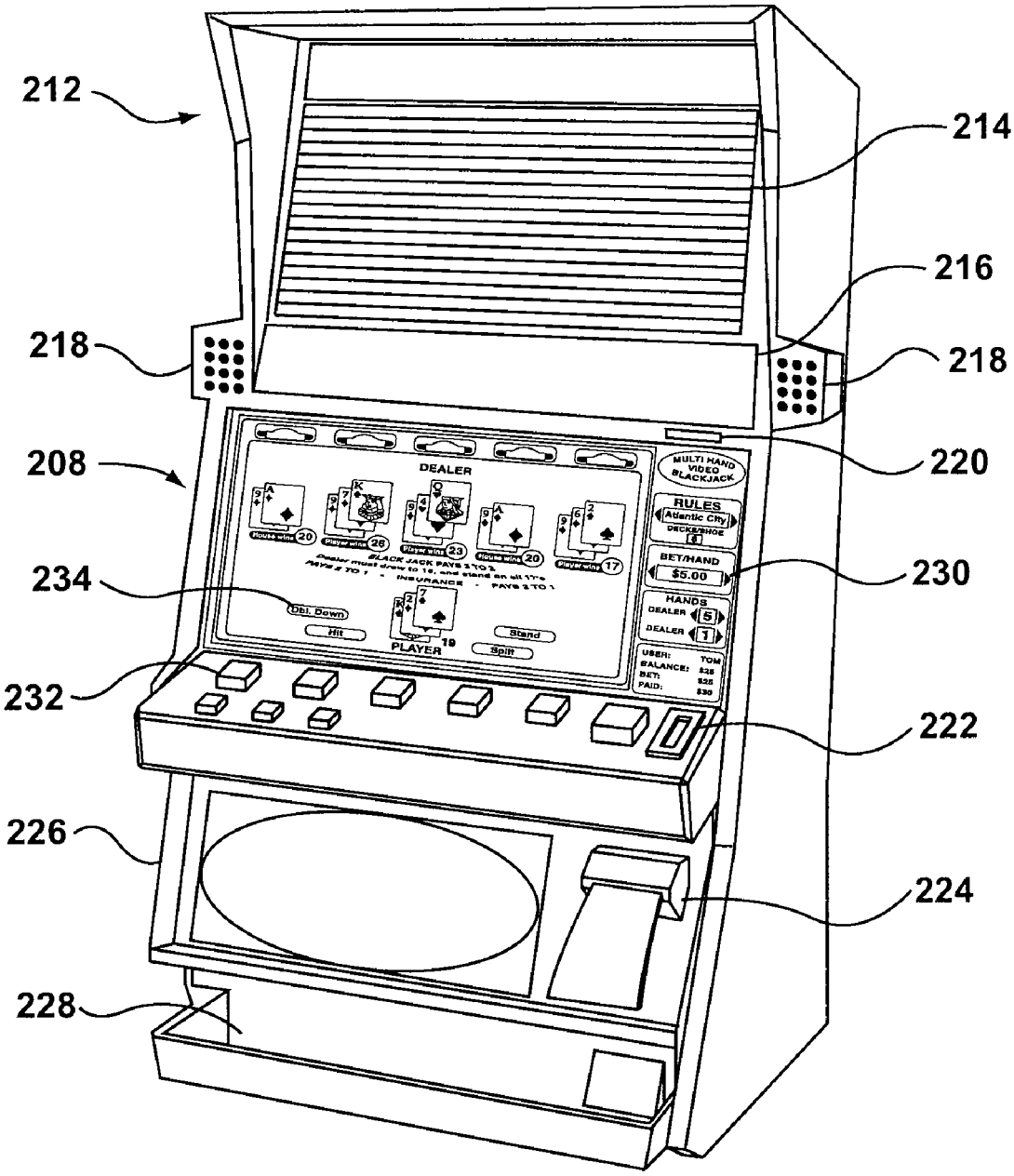
FIG. 7 is a perspective view of the gaming device of FIG. 6.

Referring to FIG. 7, the gaming device 200 may be housed in a cabinet 212. The gaming device may include a reference plate 214 that identifies the various types of games available on the gaming device 200, a name plate 216, speakers 218, a bill acceptor 220, a coin slot 222, a ticker slot 224 for coinless play, belly art plate 226, and a coin tray 228. The gaming device 200 also includes the display screen 208, game playing instructions plate 230, and game function buttons 232. The display screen 208 may also include touch screen buttons 234.

Those skilled in the art will understand that the game according to the present invention may be implemented on a wide variety of other gaming devices, such as game consoles, portable gaming devices, personal computers, laptop computers, personal digital assistants (PDAs), mobile phones, set top boxes, and interactive televisions.

FIG. 8 shows screen shots for various types of Blackjack rules. One type is Atlantic Blackjack discussed above. Those skilled in the art will appreciate that any other variations of Blackjack or Twentyone may be used, including the Single Deck Blackjack, Super Fun 21, and Progressive Blackjack shown in FIG. 8. The rules shown in FIG. 8 address variations of Blackjack, such as whether the game is progressive, number of decks per shoe, whether the player is permitted to play multiple player hands, the rules for hitting dealer's hands, whether bonus bets are available, insurance, surrender, double down, whether splitting is permitted and to what extent.

The embodiments of the present invention described herein provide a number of advantages over the prior art. By dealing each dealer hand from a corresponding card shoe and by preferably removing the cards of the player hand from each shoe, the probabilities of dealing a particular dealer hand are more uniform.

In addition, the embodiments of the present invention described herein permit greater game speed and an increased number of outcomes per time played.

While the present invention has been described with respect to what is presently considered to be the preferred embodiment, it is to be understood that the invention is not limited to the disclosed embodiments. To the contrary, the invention is intended to cover various modifications and equivalent arrangements included within the spirit of and scope of the appended claims. The scope of the following claims is to be accorded the broadest interpretation so as to encompass all such modifications and equivalent structures and functions.

The invention claimed is:

1. A method for playing an electronic multi-hand blackjack game by a player, the method comprising:

a) dealing a player hand, the player hand comprising two cards dealt face-up;

b) dealing a plurality of dealer hands, wherein each dealer hand comprises one face-up card and one face-down card, wherein the face-up card for each dealer hand is identical, wherein each dealer hand is dealt from a corresponding data structure representing a shoe, wherein each data structure comprises data representing at least one deck of cards;

c) completing the player hand according to input received from the player;

d) completing each of the plurality of dealer hands according to the conventional rules of blackjack, wherein the cards comprising each dealer hand are drawn from the corresponding shoe and no two dealer hands are drawn from the same shoe; and e) determining, using a microprocessor, a plurality of game results, wherein the plurality of game results are determined by comparing the player hand against each of the plurality of dealer hands using the conventional rules of blackjack.

2. The method of claim 1, wherein the cards dealt to the player hand in each of steps (a) and (c) are removed from each of the plurality of shoes.

3. The method of claim 2, further comprising receiving a wager from the player.

4. The method of claim 3, further comprising providing a reward to the player for each of the plurality of game results which comprises a player win.

5. The method of claim 4, wherein step (a) comprises dealing a plurality of player hands and step (c) comprises completing each of the plurality of player hands in accordance with input from the player.

6. The method of claim 5, wherein the cards dealt to each of the plurality of player hands in each of steps (a) and (c) are removed from each of the plurality of shoes.

7. The method of claim 6, wherein the number of game results is determined in accordance with the following formula:

$$GR=D\times P$$

where GR is the number of game results, D is the number of dealer hands, and P is the number of player hands.

8. The method of claim 7, further comprising selecting a predetermined number of the dealer hands to be dealt in step (b) based on input from the player.

9. The method of claim 8, further comprising selecting a predetermined number of the player hands to be dealt in step (a) based on input from the player.

10. A method for playing an electronic multi-hand blackjack game over a computer network, the method including a client device adapted for communication with a server via the computer network the method comprising:

a) dealing a player hand, the player hand comprising two cards dealt face-up;

b) dealing a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes contains at least one deck of cards;

c) completing the player hand according to instructions received from the client device;

d) completing each of the plurality of dealer hands according to the conventional rules of blackjack, wherein the cards comprising each dealer hand are drawn from the corresponding shoe and no two dealer hands are drawn from the same shoe; and e) determining a plurality of game results, wherein the plurality of game results are determined by comparing the player hand against each of the plurality of dealer hands using the conventional rules of blackjack.

11. The method of claim 10, wherein the cards dealt to the player hand in each of steps (a) and (c) are removed from each of the plurality of shoes.

12. The method of claim 11, further comprising receiving a wager from the client device.

13. The method of claim 12, further comprising providing a reward for each of the plurality of game results which comprises a player win.

14. The method of claim 13, wherein step (a) comprises dealing a plurality of player hands and step (c) comprises completing each of the plurality of player hands in accordance with instructions received from the client device.

15. The method of claim 14, wherein the cards dealt to each of the plurality of player hands in each of steps (a) and (c) are removed from each of the plurality of shoes.

16. The method of claim 15, wherein the number of game results is determined in accordance with the following formula:

$$GR=D\times P$$

where GR is the number of game results, D is the number of dealer hands, and P is the number of player hands.

17. The method of claim 16, further comprising receiving a selection of a predetermined number of the dealer hands to be dealt in step (b).

18. The method of claim 17, further comprising receiving a selection of a predetermined number of the player hands to be dealt in step (a).

19. The method of claim 18, wherein the computer network comprises the Internet.

20. A method for playing an electronic multi-hand blackjack game over a computer network, the method including a client device adapted for communication with a server via the computer network the method comprising:

a) displaying a player hand, the player hand comprising two cards dealt face-up;

b) displaying a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes contains at least one deck of cards;

c) displaying a completed player hand according to input received from the player;

d) displaying a plurality of completed dealer hands, wherein the plurality of completed dealer hands are completed according to the conventional rules of blackjack, wherein the cards comprising each dealer hand are drawn from the corresponding shoe and no two dealer hands are drawn from the same shoe; and e) displaying a plurality of game results, wherein the plurality of game results are determined by comparing the completed player hand against each of the plurality of completed dealer hands using the conventional rules of blackjack.

21. The method of claim 20, wherein the cards in the completed player hand are removed from each of the plurality of shoes.

22. The method of claim 21, further comprising receiving a wager from the player and communicating the wager to the server.

23. The method of claim 22, further displaying a reward provided to the player for each of the plurality of game results which comprises a player win.

24. The method of claim 23, wherein step (a) comprises displaying a plurality of player hands and step (c) comprises displaying a plurality of completed player hands.

25. The method of claim 24, wherein the cards dealt to each of the plurality of player hands in each of steps (a) and (c) are removed from each of the plurality of shoes.

26. The method of claim 25, wherein the number of game results is determined in accordance with the following formula:

$$GR=D\times P$$

where GR is the number of game results, D is the number of dealer hands, and P is the number of player hands.

27. The method of claim 26, further comprising receiving a selection from a player of a predetermined number of the dealer hands to be displayed in step (b).

28. The method of claim 27, further comprising receiving a selection from a player of a predetermined number of the player hands to be displayed in step (a).

29. The method of claim 28, wherein the computer network comprises the Internet.

30. A gaming device for enabling a player to play an electronic multi-hand blackjack game, the gaming device comprising:

a) an input device;

b) a display; and c) a microprocessor operable with the input device and the display to:

i) deal a player hand, the player hand comprising two cards dealt face-up;

ii) deal a plurality of dealer hands, wherein each dealer hand comprises one face-up card and one face-down card, wherein the face-up card for each dealer hand is identical, wherein each dealer hand is dealt from a corresponding data structure representing a shoe, wherein each data structure comprises data representing at least one deck of cards;

iii) complete the player hand according to input received from the input device;

iv) complete each of the plurality of dealer hands according to the conventional rules of blackjack, wherein the cards comprising each dealer hand are drawn from the corresponding shoe and no two dealer hands are drawn from the same shoe; and v) determine a plurality of game results, wherein the plurality of game results are determined by comparing the player hand against each of the plurality of dealer hands using the conventional rules of blackjack.

31. The gaming device of claim 30, wherein the cards dealt to the player hand are removed from each of the plurality of shoes.

32. The gaming device of claim 31, wherein the microprocessor is operable with the input device and the display to receive a wager from the player.

33. The gaming device of claim 32, wherein the microprocessor is operable with the input device and the display to provide a reward to the player for each of the plurality of game results which comprises a player win.

34. The gaming device of claim 33, wherein the microprocessor is operable with the input device and the display to deal and complete a plurality of player hands.

35. The gaming device of claim 34, wherein the cards dealt to each of the plurality of player hands is removed from each of the plurality of shoes.

36. The gaming device of claim 35, wherein the number of game results is determined in accordance with the following formula:

$$GR=D\times P$$

where GR is the number of game results, D is the number of dealer hands, and P is the number of player hands.

37. The gaming device of claim 36, wherein the microprocessor is adapted to select a predetermined number of the dealer hands to be dealt based on player input entered into the input device.

38. The gaming device of claim 37, wherein the microprocessor is adapted to select a predetermined number of the player hands to be dealt based on player input entered into the input device.

39. A system for enabling a player to play an electronic multi-hand blackjack game, the system comprising:

a) a server;

b) a client device adapted for communication with the server via a network; and c) the server operable with the client device to:

i) deal a player hand, the player hand comprising two cards dealt face-up;

ii) deal a plurality of dealer hands, wherein each dealer hand comprises one face-up card and one face-down card, wherein the face-up card for each dealer hand is identical, wherein each dealer hand is dealt from a corresponding shoe selected from a plurality shoes, wherein each of the plurality of shoes contains at least one deck of cards;

iii) complete the player hand according to input received from the input device;

iv) complete each of the plurality of dealer hands according to the conventional rules of blackjack, wherein the cards comprising each dealer hand are drawn from the corresponding shoe and no two dealer hands are drawn from the same shoe; and v) determine a plurality of game results, wherein the plurality of game results are determined by comparing the player hand against each of the plurality of dealer hands using the conventional rules of blackjack.

40. The system of claim 39, wherein the network is the Internet.

* * * * *